US007734473B2

(12) United States Patent
Schuijers et al.

(10) Patent No.: US 7,734,473 B2
(45) Date of Patent: Jun. 8, 2010

(54) METHOD AND APPARATUS FOR TIME SCALING OF A SIGNAL

(75) Inventors: Erik Gosuinus Petrus Schuijers, Eindhoven (NL); Andreas Johannes Gerrits, Eindhoven (NL); Arnoldus Werner Johannes Oomen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 984 days.

(21) Appl. No.: 10/597,387

(22) PCT Filed: Jan. 14, 2005

(86) PCT No.: PCT/IB2005/050159

§ 371 (c)(1),
(2), (4) Date: Jul. 24, 2006

(87) PCT Pub. No.: WO2005/073958

PCT Pub. Date: Aug. 11, 2005

(65) Prior Publication Data

US 2009/0192804 A1 Jul. 30, 2009

(30) Foreign Application Priority Data

Jan. 28, 2004 (EP) ..... 04100306

(51) Int. Cl.
*G10L 21/04* (2006.01)
*G10L 19/00* (2006.01)

(52) U.S. Cl. ..... 704/503; 704/500; 704/501; 704/504; 704/211

(58) Field of Classification Search ..... 704/500, 704/503, 211, 501, 502, 504
See application file for complete search history.

(56) References Cited

U.S. PATENT DOCUMENTS

| | | | | |
|---|---|---|---|---|
| 5,175,769 | A * | 12/1992 | Hejna et al. | 704/211 |
| 5,828,994 | A * | 10/1998 | Covell et al. | 704/211 |
| 6,278,387 | B1 * | 8/2001 | Rayskiy | 341/61 |
| 6,519,567 | B1 * | 2/2003 | Fujii | 704/503 |
| 6,801,898 | B1 * | 10/2004 | Koezuka | 704/500 |
| 6,842,735 | B1 * | 1/2005 | Covell et al. | 704/503 |
| 6,982,377 | B2 * | 1/2006 | Sakurai et al. | 84/654 |
| 7,239,999 | B2 * | 7/2007 | Rhee | 704/211 |
| 7,610,205 | B2 * | 10/2009 | Crockett | 704/503 |
| 2001/0032072 | A1 * | 10/2001 | Inoue | 704/207 |
| 2003/0105539 | A1 * | 6/2003 | Chang | 700/94 |

OTHER PUBLICATIONS

-Schuijers, E et al. "Advances in Parametric Coding for High-Quality Audio." AES Convention Paper 5852, Amsterdam, Mar. 22, 2003.*
-Schuijers, E et al. "Progress on Parametric Coding for High Quality Audio." Phillips Digital Systems Laboratories, Eindhoven, 2003.*

* cited by examiner

*Primary Examiner*—Talivaldis Ivars Smits
*Assistant Examiner*—Shaun Roberts

(57) ABSTRACT

A decoder receives (501) a bitstream comprising an encoded mono signal and stereo data. A time scale processor (503) generates a time scaled mono signal. A time-to frequency processor generates frequency sample blocks of the time scaled signal, the block length being fixed and independent of the time scaling. A parametric stereo decoder (509) generates a stereo signal for the frequency sample blocks and these are converted to the time domain by a frequency-to-time processor (511). A synchronization processor (515) synchronizes the stereo data with the time scaled signal by determining a time association between a parameter value and a frequency sample block. The parameter value and time association is used to determine synchronized stereo parameter values for that and other frequency sample blocks. The invention is particularly suitable for low complexity generation of time scaled stereo signals from MPEG-4 encoded signals.

16 Claims, 5 Drawing Sheets

PRIOR ART 100

PRIOR ART

200

METHOD AND APPARATUS FOR TIME SCALING OF A SIGNAL

FIELD OF THE INVENTION

The invention relates to a method and apparatus for time scaling of a signal and in particular to a method and apparatus for time scaling an audio signal.

BACKGROUND OF THE INVENTION

In recent years, the distribution and storage of A/V content in digital form has increased substantially. Accordingly, a large number of coding standards and protocols have been developed.

Audio coding and compression techniques provide for very efficient audio encoding which allows audio files of relatively low data size and high quality to be conveniently distributed through data networks including for example the Internet.

An example of a coding standard is the Motion Picture Expert Group-4 (MPEG-4) coding standard which provides decoder specifications for both video and audio coding. Further details of the MPEG-4 coding standard may be found in "Coding of Audio-Visual Objects", MPEG-4: ISO/IEC 14496.

A technique which may be applied to audio signals to alter the play back speed and duration of an audio signal without altering its perceived pitch is known as time scaling or tempo scaling. There are a number of interesting applications for time scaling, including for example audio/video synchronization, language learning, tools for people with impaired hearing, answering machines, spoken books, etc.

In general, time scaling is applied as a post-processing technique. Therefore, for conventional waveform coded material, an additional amount of complexity is introduced, as both regular decoding and complex time scaling processing must be performed. Furthermore, time scale processing typically introduces artefacts into the decoded signal and therefore degrades the quality of the time scaled signal. In order to achieve an acceptable quality it is necessary to use very complex time scaling algorithms resulting in increased computational requirements.

An advantage of parametric audio coding in comparison to waveform coding is that the parametric representation of an audio signal facilitates effects processing like e.g. time and/or pitch scaling processing at relatively low complexity. An example of parametric audio coding may be found in "Advances in Parametric Coding for High-Quality Audio" by Erik Schuijers, Werner Oomen, Bert den Brinker and Jeroen Breebaart, Preprint 5852, 114th AES Convention, Amsterdam, The Netherlands, 22-25 Mar. 2003.

This parametric coding scheme is currently under standardization and currently described in MPEG-4 Extension 2, "Coding of Moving Pictures and Audio, Parametric coding for High Quality Audio", ISO/IEC 14496-3:2001/FPDAM2, JTC1/SC29/WG11 and to be formally standardized in ISO/IEC 14496-3:2001/AMD2. For convenience, the term MPEG-4 extension 2 will be used in this specification. In accordance with MPEG-4 Extension 2 a stereo audio signal may be represented by the following parameter data:

Transient parameter data which represents the non-stationary part of the audio signal.

Sinusoid parameter data which represents the tonal part of the audio signal.

Noise parameter data representing the non-tonal (or stochastic) part of an audio signal.

Stereo imaging data.

MPEG-4 Extension 2 provides for stereo signals to be encoded by a Parametric Stereo (PS) algorithm. In PS, stereo audio encoding is achieved by coding a stereo audio signal as a mono signal and a small amount of stereo imaging parameters. The resulting mono signal can then be encoded by a (parametric) mono encoder. At the decoder, the mono encoded channel is expanded into stereo channels by applying the stereo imaging parameters to the decoded mono signal. The stereo parameters consist of Inter-channel Intensity Differences (IID), Inter-channel Time or Phase differences (ITD or IPD) and Inter-Channel Coherence (ICC) (or Inter-channel Cross-Correlations).

FIG. 1 illustrates an example of an MPEG-4 Extension 2 parametric stereo decoder in accordance with prior art.

The decoder 100 comprises a receiver 101 which receives an incoming, MPEG-4 Extension 2 bitstream and de-multiplexes this. The receiver 101 is coupled to decoding unit 103 to which transient, sinusoid and noise parameter data is fed. In response, the decoding unit 103 generates a mono signal.

The decoding unit 103 is coupled to a stereo processor 105 which is further coupled to the receiver 101. The stereo processor 105 receives the mono signal from the decoding unit 103 and the stereo imaging data from the receiver 101 and in response generates a stereo signal in accordance with the MPEG-4 Extension 2 parametric stereo decoding algorithm.

Parametric audio coding permits a relatively low complexity time scaling to be performed in the decoder. FIG. 2 illustrates an example of an MPEG-4 Ext. 2 time and/or pitch scaling parametric stereo decoder 200 in accordance with prior art. The decoder 200 is identical to the decoder 100 of FIG. 1 except that it further comprises a time/pitch scale unit 201. Corresponding blocks of the decoder 200 and decoder 100 have the same reference signs in FIGS. 1 and 2.

The time/pitch scale unit 201 is coupled between the receiver 100 and the decoding unit 103. The time/pitch scale unit 201 is operable to modify the parameter data before these are used to generate the decoded signal. Thus the parameters may be modified to achieve a desired tempo and pitch.

FIG. 3 illustrates a parametric stereo decoder 300 in accordance with prior art. The parametric stereo decoder 300 receives the time domain mono signal from the decoding unit 103 and in response generates a de-correlated signal in a decorrelator 301. The mono signal is further fed to a first domain transform processor 303 which generates a frequency domain representation of the mono signal. Similarly, the de-correlated signal is fed to a second domain transform processor 305 which generates a frequency domain representation of the de-correlated signal.

The first and second domain transform processors 303, 305 are coupled to a parametric stereo decoder unit 307 wherein the signals are processed to generate left and right frequency domain channels. Specifically, the stereo imaging parameters of MPEG-4 Ext. 2 are time varying frequency dependent parameters. Accordingly, the frequency domain samples are modified by:

scaling (representing the Inter-channel Intensity Difference parameters), rotation (representing the Inter-channel Phase Difference parameters) and mixing (representing the Inter-channel Coherence parameters).

As a result, the frequency domain representations for the left and right signals are generated.

The parametric stereo decoder unit 307 is coupled to a first inverse transform processor 309 and a second inverse transform processor 311 which are fed the frequency domain left and right channels respectively and in response generates the time domain left and right channels.

Conventionally, the time domain to frequency domain transforms are performed by (analysis) windowing followed by a Fast Fourier Transform (FFT) and the frequency domain to time domain transforms are performed by an inverse Fast Fourier Transform (iFFT) followed by (synthesis) windowing and subsequent overlap and add combining data from successive blocks.

It will be appreciated that when applying time scaling, it is essential that a suitable synchronization is maintained between the time scaled mono signal (and the de-correlated signal) and the stereo image parameters in order to ensure that the appropriate stereo image parameters are applied to the right samples in the parametric stereo decoder unit 307.

Conventionally, the synchronization is achieved by adjusting the window sizes applied in both time-to-frequency and frequency-to-time transform. For example, if the time scaling of the mono signal is such that the tempo is increased, fewer time domain samples need to be generated between consecutive stereo parameter values. As a result, shorter analysis and synthesis windows are applied in (inverse) domain transform processors 303, 305, 309 and 311. However, in view of computational complexity, the (inverse) transform length is preferably kept constant. Hence, zero padding of the analysis and synthesis windows up to the pre-determined transform length is applied.

In the conventional approach, the stereo parameters are taken directly from the bitstream and used for the processing by the parametric stereo decoder unit 307. Accordingly, the stereo parameters and block processing of the parametric stereo decoder unit 307 may be considered to be synchronized with the original non-time scaled signal. In order to compensate for this, the block times of the FFT and iFFTs are modified accordingly by use of windowing techniques. This approach allows a very flexible and accurate time scaling with high granularity.

The complexity associated with windowing and FFTs is very high, especially in terms of memory requirements. In order to reduce complexity of the parametric stereo decoding tools, it is desirable to replace the time-to-frequency and frequency-to-time transform in the parametric stereo decoder by down-sampled complex-exponential modulated filter banks. The complex-valued sub-band domain samples are generated by convolution (filtering) of the input signal with a complex-exponential modulated proto-type filter. By application of decomposition techniques the number of multiplications and additions required for performing this filtering is minimized. Further description of down-sampled complex-exponential modulated filter banks may be found in "Bandwidth extension of audio Signals by Spectral Band replication" by P. Ekstrand, Proc. 1st IEEE Benelux Workshop on Model Base Processing and Coding of Audio (MPCA-2002), Leuven, Belgium, Nov. 15, 2002.

In contrary to the flexibility of the analysis/synthesis windowing in the FFT-based approach, usage of the complex modulated filter banks results in a fixed block based conversion and processing. In case of a typical 64-bands complex-modulated filter bank, for effectively each 64 input sample block, 64 complex-valued sub-band domain samples are generated as illustrated in FIG. 4. (It should be noted that the lower three bands are divided further in frequency for increased frequency resolution required for the stereo reconstruction). The time interval associated with each of these blocks is fixed. However, as the time intervals for the time scaled signals are constant, the length of corresponding time intervals of the non-time scaled signal varies depending on the time scaling applied. For example, for an increased tempo, 64 samples of the time scaled mono signal will correspond to more than 64 samples of the originally encoded non-time scaled time signal. As the stereo imaging parameter values of the bitstream are inherently synchronized with the originally encoded non-time scaled time signal and as the time to frequency domain transforms cannot compensate for the time scaling, the stereo imaging parameters will generally not be synchronized with the frequency domain samples in the stereo decoding unit.

Hence, an improved system for time scaling would be advantageous and in particular a system allowing for increased flexibility, lower complexity, performance and/or signal quality would be advantageous. In particular, an improved system for time scaling of an MPEG-4 stereo signal having reduced complexity and/or improved synchronization would be an advantage.

SUMMARY OF THE INVENTION

Accordingly, the Invention preferably seeks to mitigate, alleviate or eliminate one or more of the above mentioned disadvantages singly or in any combination.

According to a first feature of the invention there is provided an apparatus for time scaling a signal comprising: means for receiving an input signal comprising a first signal and extension data; means for generating a time scaled signal of the first signal; means for generating a plurality of frequency sample blocks for the time scaled signal, each frequency sample block corresponding to a fixed time interval of the time scaled signal, the fixed time interval being independent of a time scaling factor; means for determining a first time association between a first parameter value of the extension data and a first frequency sample block having an associated first time interval of the time scaled signal; means for determining a second parameter value associated with a second frequency sample block in response to the first time association and the first parameter value; means for modifying data of the second frequency sample block in response to the second parameter value; and means for generating time domain output sample blocks from the frequency sample blocks.

The invention provides for efficient time scaling of signals. The first signal may specifically be an encoded signal. In particular, the invention allows the use of fixed length domain transfer blocks of the time scaled signal. The length of the (frequency) domain transfer blocks is thus independent of the time scaling factor. Specifically, the invention may allow time scaling of signals without requiring that a time scaled signal is compensated by a variable length (as a function of the time scaling values) block transform. Hence, the requirement for variable windowing of the time scaled signal may be mitigated or obviated. Instead, the means for generating frequency sample blocks, means for modifying data and the means for generating time domain output sample blocks may all process data in fixed size block steps that correspond to a fixed number of samples of the time scaled signal. The fixed number is independent of the time scaling. Specifically, there is preferable a fixed ratio between the number of frequency samples and the number of time samples of the scaled time signal and preferably one frequency sample is generated for each time sample. Thus, for a block step size of e.g. 64 samples, the means for generating the plurality of frequency sample blocks preferably generates 64 frequency samples.

The actual block processing may involve data from other blocks. For example, the means for generating the plurality of frequency sample blocks may base the transform on a number of samples which exceeds the block size.

This may allow for particularly low complexity processing and specifically allows the use of simplified domain transfer functionality. In particular, the invention may allow time scaling using down-sampled complex-exponential modulated filter banks.

The invention provides a low complexity and high performance means of synchronizing the parameter values of the extension data with the time scaled signal. Specifically, the invention allows a simple process of time scaling the parameter values to correspond to the time scaling applied to the time scaled signal.

According to a feature of the invention the means for determining the first time association comprises determining the first frequency sample block as that having an associated time interval corresponding to a time instant associated with the first parameter value.

This allows a simple implementation and a feasible way of determining a time association which may be used to synchronize between the parameter values and the time scaled signal. Specifically, the time association for a given parameter value may simply indicate which frequency sample block corresponds to a non-scaled time instant of the parameter value in the received bitstream.

According to a different feature of the invention, the first time association comprises an indication of a time position of the parameter value within the first time interval.

The time association may comprise a fractional time indication of the parameter value. Specifically, the indication may be a relative time indication which indicates to which relative fraction of the first time interval the parameter value applies. This may allow a much improved and closer synchronization between the parameter values of the extension data and the time scaled signal. In particular, it may substantially improve the accuracy of the calculated second parameter value and may allow much higher time resolution scaling of the parameter values thereby providing for a finer time scaling resolution.

According to a different feature of the invention, the apparatus further comprises means for determining a second time association between a third parameter value of the extension data and a third frequency sample block; and the means for determining the second parameter is operable to perform an interpolation in response to the first parameter value, the first time association, the third parameter value and the second time association. Preferably, the interpolation is a linear interpolation.

This may provide a low complexity yet high performance implementation. Specifically, it may allow an efficient means of determining a second parameter value with a high time resolution, i.e. it may allow for the second parameter value to be accurately determined for a desired time instant.

According to a different feature of the invention, the means for determining the first time association is operable to determine the first time association in response to a previous time association.

According to a different feature of the invention, the apparatus further comprises means for determining a scaled time offset between consecutive parameter values of the extension data and the means for determining the first time association is operable to determine a time instant of the first parameter value in response to a previous parameter value and the scaled time offset and generating the time association in response to the time instant.

Typically, the parameter values of the extension data may occur at regular intervals, for example at every 1024 samples of the encoded non-time scaled signals. Thus, in the non-scaled time domain, a time offset between consecutive parameter values is 1024 samples. The corresponding scaled time offset will be different for the time scaled signal. For example, if the play back rate is increased by 10% the 1024 samples will correspond to 922 samples of the time scaled signal. Thus, the time instant of the first parameter value with respect to the time scaled signal may be determined as the time scaled sample of the previous parameter value plus 922 samples. This provides for a simple means of synchronizing the time scaled signal and the parameter values.

Preferably, the time association is determined relative to the time sample blocks. For example, if the time sample block comprises 64 samples of the time scaled signal, a time indication of 2.75 corresponds to the $48^{th}$ sample of the third block. The scaled time offset is also preferably determined relative to the time sample blocks. Thus, a scaled time offset of 922 may be equivalent to a scaled time offset of 14.41 time simple blocks. If the previous parameter value occurred at a scaled time domain of 2.75, the subsequent parameter value may be determined to correspond to a scaled domain time of 2.75+14.41=17.16 i.e. to scaled time sample 10 of time sample block 17.

According to a different feature of the invention, the means for determining the second parameter value is operable to associate the first parameter value with a nominal time position within the first time interval in response to the time association and to determine the second parameter value in response to the first parameter value and the nominal time position. Preferably, the means for determining the second parameter value is operable to determine the second parameter value in response to an interpolation in response to the first parameter value and the nominal time position.

Specifically, the nominal time position may be the mid time instant of the time sample block. For example, having calculated a time instant of the first parameter value of 17.16, interpolation between the first parameter value assuming this is at a position of 17.5 and the previous parameter value assuming this is at a position of 2.5 may be carried out. The exact time instant association is preferably used to determine the time instant of subsequent parameters. Thus, the following parameter value may preferably be determined to occur at 17.16+14.41=31.57.

The nominal position may for example be a mid-point, end point, quantized or integer time value related to the first time interval. This feature may simplify determination of the second parameter value while ensuring high scaled time domain accuracy of time indications of the time association.

Preferably the input signal is a parametric encoded audio signal and specifically it may be an MPEG-4 encoded audio signal (such as an MPEG-4 Ext. 2 encoded audio signal).

According to a different feature of the invention, the means for generating the frequency sample blocks comprise complex-exponential modulated filter banks (e.g. a QMF based filter bank). Similarly, the means for generating time domain output sample blocks preferably comprises complex-exponential modulated filter banks. The invention may thus facilitate or enable a reduced complexity time scaling decoder and in particular the requirement for analysis windowing in association with domain transforms may preferably be obviated.

According to a different feature of the invention, the extension data comprises parametric stereo data and preferably the first parameter value is a parameter value of a stereo image parameter selected from the group consisting of: Inter-channel Intensity Differences parameters; Inter-channel Time or Phase differences parameters; and Inter-Channel Coherence parameters. Preferably, the means for determining a second parameter value is operable to process the frequency sample blocks in accordance with a parametric stereo protocol and specifically in accordance with the parametric stereo protocol described in MPEG-4 Extension 2. Preferably, the means for modifying is operable to modify the data of the second frequency sample block to generate at least a first stereo channel frequency sample block. Hence the invention may allow an efficient low complexity generation of stereo signals from an MPEG-4 parametric stereo bit stream.

Alternatively or additionally, the extension data may comprise spatial audio data. For example, the extension data may comprise data which allows generation of further spatial channels, such as for example center and rear channels.

According to a different aspect of the invention, there is provided a method of time scaling a signal, the method comprising the steps of: receiving an input signal comprising a first signal and extension data; generating a time scaled signal of the first signal; means for generating a frequency sample blocks for the time scaled signal, each frequency sample block corresponding to a fixed time interval of the time scaled signal, the fixed time interval being independent of the time scaling factor; determining a first time association between a first parameter value of the extension data and a first frequency sample block having an associated first time interval of the time scaled signal; determining a second parameter value associated with a second frequency sample block in response to the first time association and the first parameter value; modifying data of the second frequency sample block in response to the second parameter value; and generating time domain output sample blocks from the frequency sample blocks.

These and other aspects, features and advantages of the invention will be apparent from and elucidated with reference to the embodiment(s) described hereinafter.

BRIEF DESCRIPTION OF THE DRAWINGS

An embodiment of the invention will be described, by way of example only, with reference to the drawings, in which.

DESCRIPTION OF PREFERRED EMBODIMENTS

The following description focuses on an embodiment of the invention applicable to an audio time scaling decoder and in particular to an MPEG-4 Extension 2 stereo decoder comprising time scaling functionality. However, it will be appreciated that the invention is not limited to this application but may be applied to many other signals and applications.

It will be appreciated that although the specific description focuses on this embodiment, the principles, alternatives and features described herein are not necessarily limited to this specific embodiment but may optionally be applied to other suitable embodiments.

Figure 5:
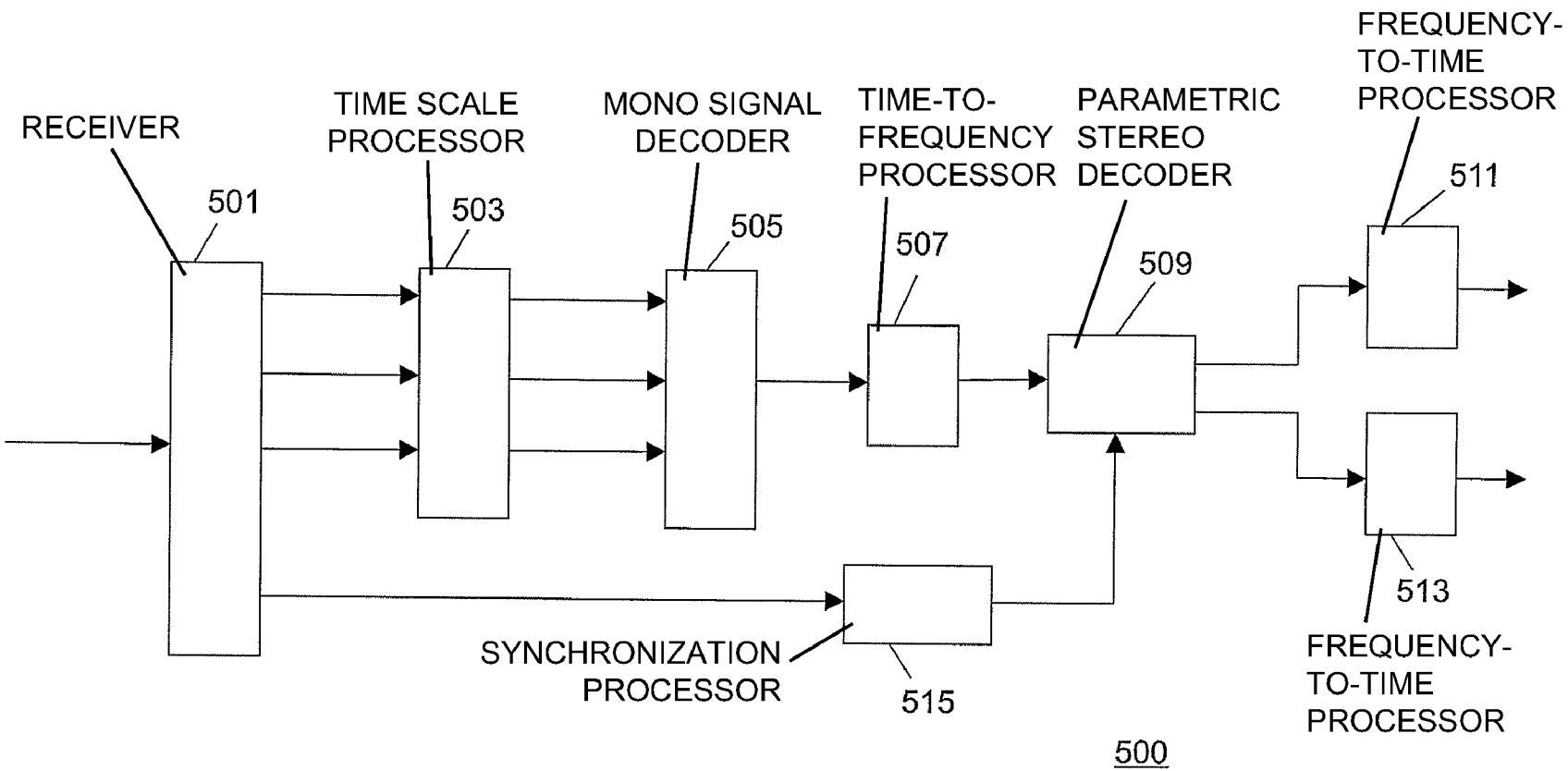
FIG. 5 illustrates a time scaling decoder in accordance with an embodiment of the invention.

FIG. 5 illustrates a time scaling decoder 500 in accordance with an embodiment of the invention.

The time scaling decoder 500 comprises a receiver 501 which receives an MPEG-4 Extension 2 encoded stereo signal from an external or internal source (not shown). The receiver 501 may for example receive an MPEG-4 Extension 2 bitstream from a network connection or may retrieve the signal from an internal memory or processor.

The MPEG-4 Extension 2 bitstream comprises a parametrically encoded mono signal in the form of transient, sinusoidal and noise parameter data. In addition, the MPEG-4 Extension 2 bitstream comprises extension data in the form of parametrically encoded stereo image parameters. Specifically, the MPEG-4 Extension 2 bitstream comprises stereo extension data in the form of Inter-channel Intensity Difference (IID) parameters, Inter-channel Time or Phase Difference (ITD) parameters and Inter-Channel Coherence (ICC) parameters.

The receiver 501 is coupled to a time scale processor 503 which is fed the encoded signal data including the transient, sinusoidal and noise parameters. The time scale processor 503 processes the transient, sinusoidal and noise parameters in response to a tempo and pitch requirement. Thus, the time scale processor 503 generates time scaled transient, sinusoidal and noise parameters which have the desired pitch and playback rate. It will be appreciated that any suitable time scale processing of the parameters may be applied without detracting from the invention. For example the length of the sinusoidal synthesis windows and the noise envelope may be time scaled.

The time scale processor 503 is coupled to a mono signal decoder 505 which receives the time scaled transient, sinusoidal and noise parameters from the time scale processor 503. In response, the mono signal decoder 505 generates a time scaled mono signal. The time scaled transient, sinusoidal and noise parameters are preferably MPEG-4 Extension 2 compatible parameters and the mono signal decoder 505 may specifically employ a conventional MPEG-4 Extension 2 parametric decoding algorithm as well known to the person skilled in the art.

Specifically, the mono signal decoder 505 may generate a decoded time scaled pulse code modulated (PCM) signal. The time scaled signal has a real time alignment which is different than the real time alignment of the originally encoded signal. For example, if a time scaling corresponding to the tempo being increased by 10% is applied, a time interval corresponding to 1 second for the original encoded signal will correspond to a time scaled time interval of 0.9 seconds of the time scaled signal. Assuming an identical sample rate of 48 kHz, the original mono encoded signal would comprise 48000 samples whereas the time scaled signal will only comprise $0.9 \cdot 48000 = 43200$ samples. It is clear that the time scaled time interval and the number of samples corresponding to a given non-time scaled time interval will depend on the extent of the applied time scaling.

The mono signal decoder 505 is coupled to a time-to-frequency processor 507 which receives the time scaled signal. The time-to-frequency processor 507 transforms the time scaled signal into consecutive frequency sample blocks effectively corresponding to equal numbers of time domain samples. In the specific embodiment, the time-to-frequency processor 507 effectively transforms each block of 64 time scaled signal samples into blocks of 64 sub-band domain samples which are subsequently processed on a block basis.

The division of samples into fixed size blocks is independent of the time scale factor applied by the time scale processor 503. Thus, each block corresponds to a fixed time interval of the time scaled signal. For example, for a sample rate of 48 kHz, each block correspond to an interval of 64/4800 kHz=1.33 msec regardless of the magnitude of the time scaling. However, as the associated time scale intervals are fixed with respect to the time scaled signal, the corresponding time intervals of the originally encoded signal will vary depending on applied the time scale factor.

The time-to-frequency processor 507 is operable to generate a frequency sample block for each block of the time scaled signal. Thus, in each block processing step, the time-to-frequency processor 507 generates 64 frequency samples which correspond to 64 time samples of the time scaled signal. However, the time-to-frequency processor 507 may include other samples than these 64 time samples in the generation of the frequency sample block.

Specifically, the time-to-frequency processor 507 comprises a down-sampled complex-exponential modulated filter bank which generates a frequency sample block.

Similarly, to an FFT process the complex-exponential modulated filter banks makes use of complex-modulated transforms. The complex-exponential modulated filter banks of the described embodiment (e.g. a QMF based filter bank) generates 64 output samples using 640 input samples in the transform. However, the block step (or hop-size) is only 64 samples. Thus, a first 640 input samples give a first set of 64 filtered coefficients, then the last 640−64=576 plus 64 new input samples are used to generate a second set of 64 filtered coefficients etc. Thus, although the transform itself extends over more than the current block, an input block of 64 samples of the time scaled signal will result in a frequency sample block comprising 64 frequency domain samples.

Figure 1:
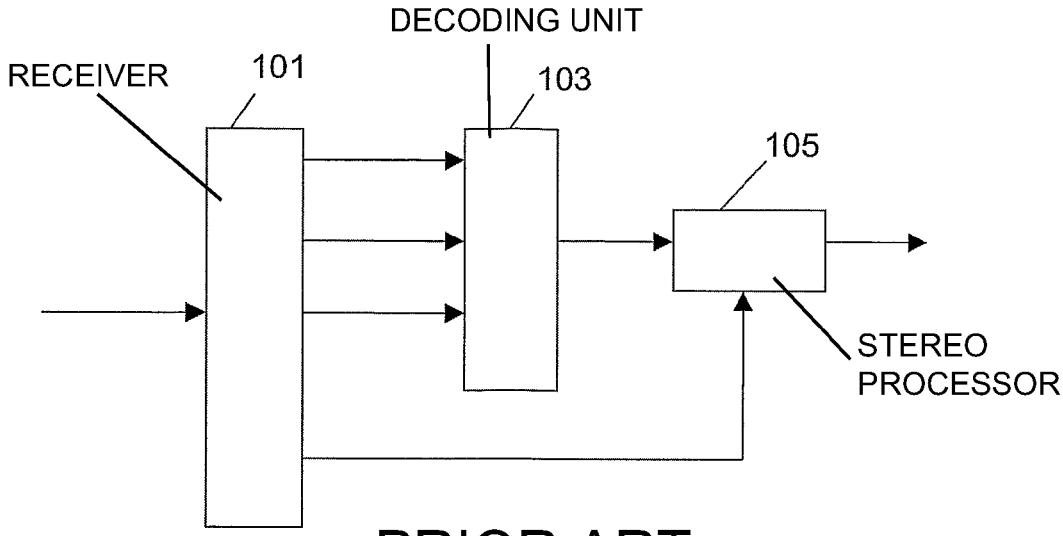
FIG. 1 illustrates an example of an MPEG-4 Extension 2 parametric stereo decoder in accordance with prior art.
Figure 2:
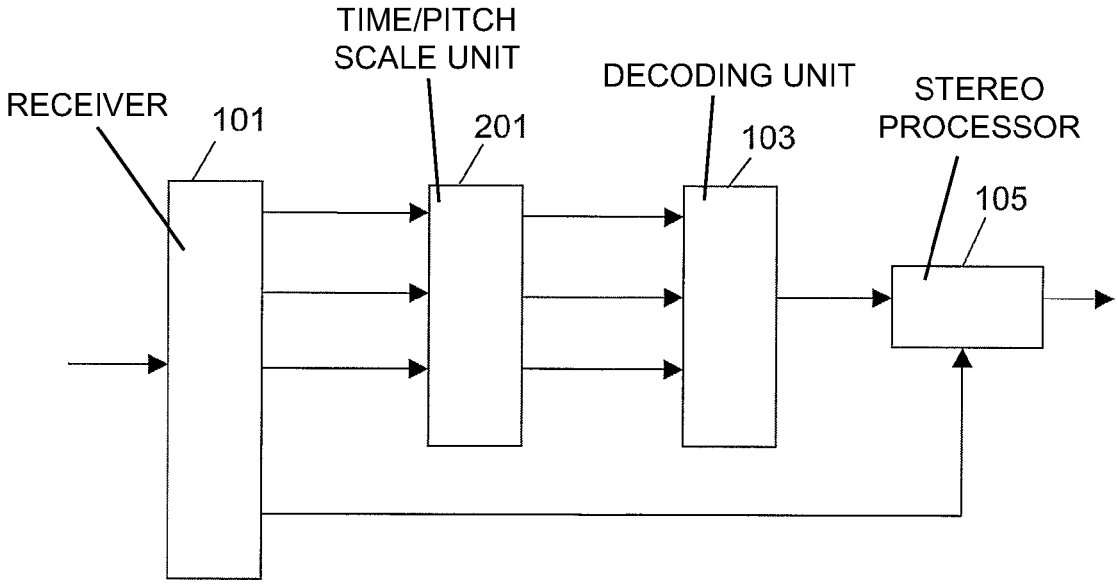
FIG. 2 illustrates an example of an MPEG-4 Extension 2 time scaling parametric stereo decoder in accordance with prior art.
Figure 3:
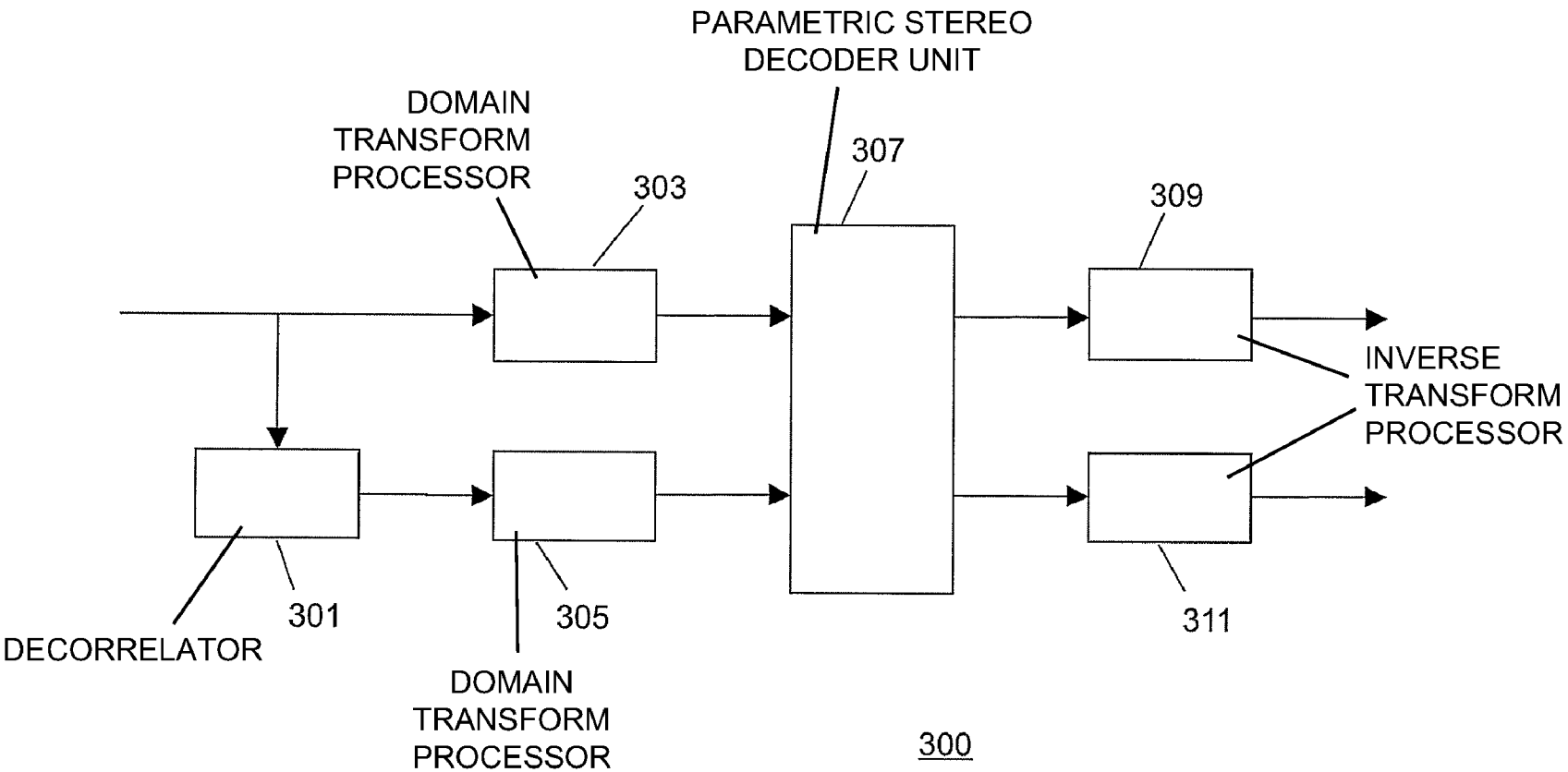
FIG.3 PRIOR ART
FIG. 3 illustrates a parametric stereo decoder in accordance with prior art.
Figure 4:
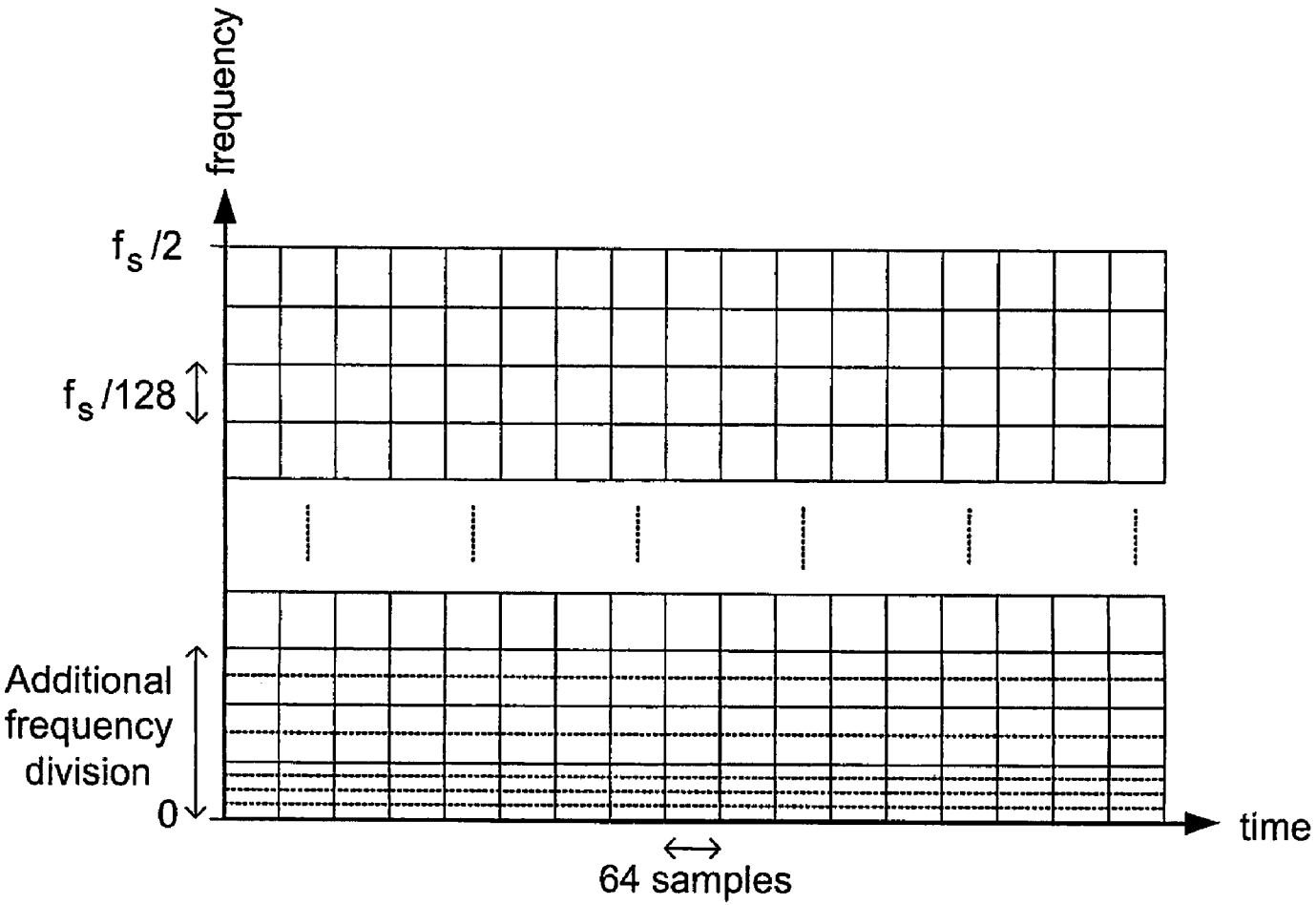
FIG. 4 illustrates a time-frequency diagram comprising frequency sample blocks.

Thus, for each time sample block of 64 samples of the time scaled signal, the time-to-frequency processor 507 effectively generates a frequency sample block of 64 frequency samples as illustrated in FIG. 4.

The time-to-frequency processor 507 is coupled to a parametric stereo decoder 509 which receives the frequency sample blocks as well as parametric stereo parameters. The parametric stereo decoder 509 processes each frequency sample block in response to the parametric stereo parameters to generate a left and right channel frequency domain signals.

Specifically, the parametric stereo decoder 509 scales the individual frequency samples in response to the appropriate subband IID parameters and rotates the parameters in response to the ITD parameters.

It will be appreciated that for brevity and clarity the above description focuses on generation of a stereo signal without generation of a de-correlated signal. However, in practical applications, improved quality may be achieved by the generation and processing of a de-correlated signal as will be appreciated by the person skilled in the art. Specifically, the mono signal and a de-correlated signal may be mixed in response to ICC parameters.

Thus, the parametric stereo decoder 509 may generate a frequency sample stereo block (or equivalently may generate two frequency domain sample blocks corresponding to the left and right channel). It will be appreciated that parametric stereo decoder 509 may process the frequency sample blocks in accordance with a suitable MPEG-4 Extension 2 compatible parametric stereo decoding algorithm. Thus, the parametric stereo decoder 509 is operable to modify the data of the frequency sample block in order to generate at least a first stereo channel frequency sample block.

The parametric stereo decoder 509 is coupled to a first and second frequency-to-time processor 511, 513. The first frequency-to-time processor 511 receives the modified frequency sample blocks and specifically the first frequency-to-time processor 511 receives the samples of the modified frequency sample blocks corresponding to the left channel and the second frequency-to-time processor 513 receives the samples of the modified frequency sample blocks corresponding to the left channel.

The first and second frequency-to-time processors 511, 513 perform a frequency-to-time domain transform and thus generates time domain sample blocks for the left and right stereo channel respectively. Thus, a time scaled stereo signal is provided.

It will be appreciated that the processing of the parametric stereo decoder 509 is a frequency domain block based processing. Each frequency sample block of 64 frequency subband samples corresponds effectively to a time sample block of 64 time samples of the time scaled signal, and thus each of the frequency sample blocks is associated with a time interval of the time scaled signal which is independent of the time scale factor. Consequently, each frequency sample block corresponds to a variable time interval of the originally encoded non-time scaled signal. The length of the non-scaled time interval depends on the time scale factor.

However, the stereo image parameters used by the parametric stereo decoder 509 are received in the MPEG-4 Extension 2 bitstream and are synchronized with the time alignment of the original non-time scaled signal. Thus, it is necessary to synchronize the parameter values and the time scaled signal when performing the processing by the parametric stereo decoder 509.

One option is to use variable size sample blocks by varying the sample block size in response to the time scaling factor or equivalently varying the time scaled time interval associated with each block in response to the time scaling factor. However, as mentioned previously, this requires complex operations and specifically requires alternate windowing thereby resulting in a high computational burden.

In the current embodiment, fixed time interval block processing of the time scaled signal is maintained and instead stereo image parameter values are generated which are compatible with the fixed time block processing. Thus, rather than synchronizing by modifying the time relationship between the time scaled signal and the block based processing, synchronization is achieved by synchronizing the stereo parameters to the fixed time block processing.

Accordingly, the time scaling decoder 500 comprises a synchronization processor 515 which is coupled to the receiver 501 and the parametric stereo decoder 509 and which receives the non-time scaled stereo parameters from the receiver 501 and generates stereo parameters that are synchronized with the time scaled mono signal and thus with the fixed size block processing.

Specifically, the synchronization processor 515 is operable to determine a time association between a stereo parameter value and a frequency sample block. In a simple embodiment, the time association simply comprises an indication of which sample frequency block the stereo parameter value corresponds to. For example, if a stereo parameter is updated every 16 blocks of 64 samples in the non-scaled time signal and the time scaling factor is such that the 16 non-time scaled blocks of 64 samples corresponds to only 15 blocks of the time scaled signal, the synchronization processor 515 may simply determine the frequency sample blocks associated with the stereo parameters as every fifteenth block.

In this example, a stereo parameter value is received for every fifteenth frequency sample block. The stereo parameter values of other frequency blocks may be calculated by interpolating between the received stereo parameter values. Thus, after determining which frequency sample blocks the stereo parameter values apply to, the parameter values of other frequency sample blocks may be determined in response to these parameter values and the timing of the frequency sample blocks they belong to.

This may allow for a simple implementation which is particularly suitable for time scaling factors that correspond to the fixed time intervals of the block processing (i.e. in steps of 64 samples in the non-scaled time domain). However, for finer granularities of the time scaling factor, the calculated parameter values may be too inaccurate to achieve a desired quality. Therefore, it is typically preferable to determine the time association to further indicate a time position of the stereo parameter value within the time interval of the frequency sample block to which the parameter values is considered to belong.

In the following, this approach will be illustrated with an example wherein a time scaling is performed whereby 16 blocks of the non-time scaled signal are time scaled to 14.5 blocks. Thus, assuming the same sampling frequency, the time scale processor 503 is operable to modify the encoded parameters such that 16·64 samples=1024 samples of the original signal are scaled to 14.5·64 samples=934 samples of the time scaled signal. In the example, a new value of the stereo parameters is received for every 16 blocks i.e. for every 1024 samples of the original non-time scaled signal.

Figure 6:
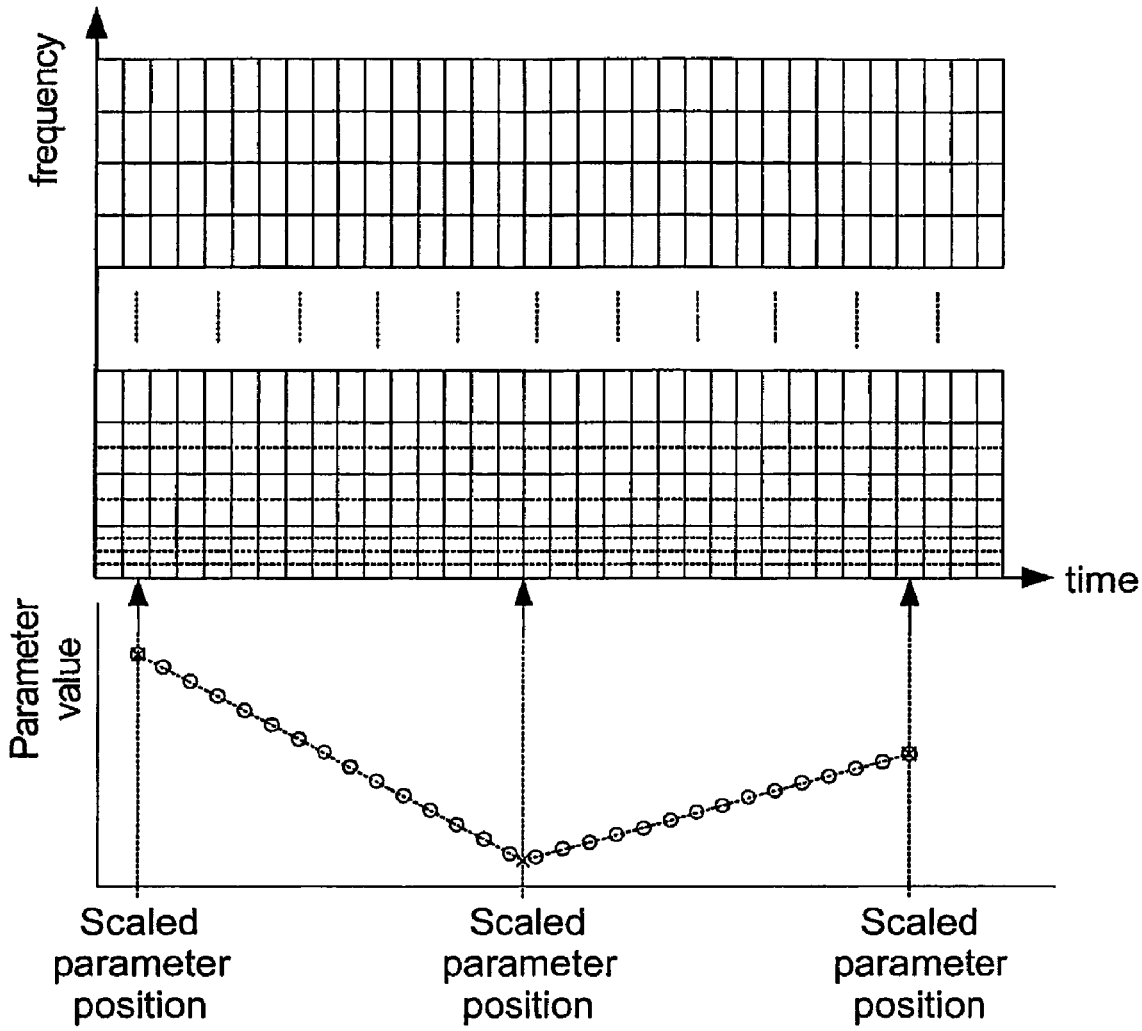
FIG. 6 graphically illustrates a method of determining time scaled parameter values in accordance with an embodiment of the invention.

FIG. 6 graphically illustrates a method of determining time scaled parameter values in accordance with this example. In the following, the time indication of for stereo parameters is given in terms of the associated frequency sample block time intervals. Thus, in the example of FIG. 6, the first frequency sample block corresponds to a time indication from 0 to 1, the second frequency sample block to a time interval from 1 to 2 etc.

As shown, an initial parameter value is received at time 1.5. The scaled time offset between parameters in the scaled time domain is 14.5 blocks and the corresponding time instant of the next parameter value may be calculated as 1.5+14.5=16 as illustrated in the FIG. 6. Thus, the stereo parameter value is known at time instant 1.5 and time instant 16 and therefore the appropriate stereo parameter values appropriate for the intervening frequency sample blocks may be determined by a simple interpolation. For example, if the parameter value at time instant 1.5 is $x_1$ and the parameter value at time instant 16 is $x_2$, an appropriate parameter value for the third frequency sample block (corresponding to time instant 2.5) may be calculated from:

$$x_i = x_1 + (x_2 - x_1) \cdot \frac{2.5 - 1.5}{16 - 1.5}$$

More generally, in a parametric stereo decoder based on the complex-exponential modulated filter banks, the stereo sub-band signals are typically constructed by the following equations:

$$l_k(n)=H_{11}(k,n)m_k(n)+H_{21}(k,n)d_k(n)$$

$$r_k(n)=H_{12}(k,n)m_k(n)+H_{22}(k,n)d_k(n)'$$

where the signals $m_k(n)$ and $d_k(n)$ represent the complex-valued sub-band domain mono and de-correlated signal for sub-band index k, n represents the sub-band sample index and the matrices $H_{11}(k,n)$, $H_{12}(k,n)$, $H_{21}(k,n)$ and $H_{22}(k,n)$ represent parameter manipulation matrices.

The previous and current (not necessarily integer) scaled parameter positions may be denoted by $\hat{n}_{prev}$ and $\hat{n}_{curr}$ respectively. Based on the received stereo parameters, the vectors $H_{11}(k,\hat{n}_{curr})$, $H_{12}(k,\hat{n}_{curr})$, $H_{21}(k,\hat{n}_{curr})$ and $H_{22}(k,\hat{n}_{curr})$ may be calculated.

If $H_{11}(k,\hat{n}_{prev})$, $H_{12}(k,\hat{n}_{prev})$, $H_{21}(k,\hat{n}_{prev})$ and $H_{22}(k,\hat{n}_{prev})$ have been calculated in a previous step, the manipulation matrices may then for $$n = (\lceil \hat{n}_{prev} \rceil \ldots \lfloor \hat{n}_{curr} \rfloor)$$

be calculated from:

$$H_{11}(k, n) = H_{11}(k, \hat{n}_{prev}) + (n - \hat{n}_{prev}) \frac{H_{11}(k, \hat{n}_{curr}) - H_{11}(k, \hat{n}_{prev})}{\hat{n}_{curr} - \hat{n}_{prev}}$$

$$H_{12}(k, n) = H_{12}(k, \hat{n}_{prev}) + (n - \hat{n}_{prev}) \frac{H_{12}(k, \hat{n}_{curr}) - H_{12}(k, \hat{n}_{prev})}{\hat{n}_{curr} - \hat{n}_{prev}}$$

$$H_{21}(k, n) = H_{21}(k, \hat{n}_{prev}) + (n - \hat{n}_{prev}) \frac{H_{21}(k, \hat{n}_{curr}) - H_{21}(k, \hat{n}_{prev})}{\hat{n}_{curr} - \hat{n}_{prev}}$$

$$H_{22}(k, n) = H_{22}(k, \hat{n}_{prev}) + (n - \hat{n}_{prev}) \frac{H_{22}(k, \hat{n}_{curr}) - H_{22}(k, \hat{n}_{prev})}{\hat{n}_{curr} - \hat{n}_{prev}}.$$

The embodiment may accordingly provide for a low complexity method of generating stereo parameter values which are time aligned with the time scaled mono signal and thus the fixed scaled time domain interval block processing of the parametric stereo decoder 509. This may further allow a significantly reduced complexity as simpler domain transform functions may be used.

In the example, the described interpolation was performed using the actual fractional time instants determined for the received parameter values. However, in some embodiments, it may be desirable to perform the interpolation based on nominal time instants. Specifically this may allow for reduced complexity of the processing and may in particular reduce or eliminate the need for complex and resource demanding multiplications or divisions.

Accordingly, after determining the fractional time instant for a given parameter value, this may be associated with a nominal time position within the time interval for the further processing. Thus, the determined time positions may be shifted to the nearest nominal value, such as for example to the midpoint of the corresponding frequency sample block time interval, for the purpose of interpolation. However, preferably the determined fractional value of the time instant is used for calculation of the time instant of the next parameter value.

As a specific example, the parameter value of FIG. 6 occurring at time instant 16.0 may be moved to time instant 16.5 (or 15.5) for the purpose of interpolation. Thus the interpolation of the parameter value for the third frequency sample block (corresponding to time instant 2.5) may be calculated from:

$$x_i = x_1 + (x_2 - x_1) \cdot \frac{1}{15}$$

However, the calculation of the next time instant for the following parameter value will still be based on the accurate value i.e. the following parameter will be considered to be at time instant 16.0+14.5=30.5. In this way, the correct average parameter frequency update will be maintained.

The time shift of the parameter values for the purpose of interpolation will result in different sample values corresponding to the parameter values. However, since the shift is typically less than 64 samples, no audible artefacts are introduced by the shift.

In general, it will be appreciated that it is significant that the update rate of the time scaled parameter values is synchronized with the time scaled mono signal in order to ensure that synchronization is maintained between these. However, a minor absolute time offset (say less than 64 samples) has negligible effect on the perceived quality.

Denoting the previous and current (not necessarily integer) parameter value time instants by $\hat{n}_{prev}$ and $\hat{n}_{curr}$ respectively, another method of mapping the non-integer parameter positions $\hat{n}_{prev}$ and $\hat{n}_{curr}$ to integer positions $n_{prev}$ and $n_{curr}$ is given by the following recursion. It is assumed that N is the number of samples in a block (for example 64). The following values are determined:

$$x_1 = n_{prev} \cdot N + 1$$

$$x_2 = \hat{n}_{curr} \cdot N$$

$$m = \mathrm{mod}(x_2 - x_1 + 1, N)$$

where $n_{prev}$ is the previous integer position.

The current integer parameter position is then calculated as follows:

$$n_{curr} = \hat{n}_{curr} + 1 - \frac{m}{N}$$

In order to initiate the recursion, $n_{prev}=0$.

The invention can be implemented in any suitable form including hardware, software, firmware or any combination of these. However, preferably, the invention is implemented as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with the preferred embodiment, it is not intended to be limited to the specific form set forth herein. Rather, the scope of the present invention is limited only by the accompanying claims. In the claims, the term comprising does not exclude the presence of other elements or steps. Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is no feasible and/or advantageous. In addition, singular references do not exclude a plurality. Thus references to "a", "an", "first", "second" etc do not preclude a plurality.

The invention claimed is:

1. An apparatus for time scaling a signal comprising:

means for receiving an input signal comprising a first signal and extension data associated with the first signal;

means for generating a time scaled signal of the first signal;

means for generating a plurality of frequency sample blocks for the time scaled signal, each frequency sample block corresponding to a fixed time interval of the time scaled signal, the fixed time interval being independent of a time scaling factor;

means for determining a first time-association between a first parameter value of the extension data and a first frequency sample block having an associated first time interval of the time scaled signal;

means for determining a second parameter value associated with a second frequency sample block in response to the first time-association and the first parameter value;

means for modifying data of the second frequency sample block in response to the second parameter value; and means for generating time domain output sample blocks from the frequency sample blocks.

2. The apparatus as claimed in claim 1, wherein the means for determining the first time-association is operable to determine the first frequency sample block as that having an associated time interval corresponding to a time instant associated with the first parameter value.

3. The apparatus as claimed in claim 1, wherein the first time-association comprises an indication of a time position of the parameter value within the first time interval.

4. The apparatus as claimed in claim 1, wherein said apparatus further comprises:

means for determining a second time association between a third parameter value of the extension data and a third frequency sample block, and wherein the means for determining the second parameter value is operable to perform an interpolation in response to the first parameter value, the first time association, the third parameter value and the second time association.

5. The apparatus as claimed in claim 4, wherein the interpolation is a linear interpolation.

6. The apparatus as claimed in claim 1, wherein the means for determining the first time-association is operable to determine the first time-association in response to a previous time association.

7. The apparatus as claimed in claim 1, wherein said apparatus further comprises:

means for determining a scaled time offset between consecutive parameter values of the extension data, and wherein the means for determining the first time-association is operable to determine a time instant of the first parameter value in response to a previous parameter value and response to the time instant.

8. The apparatus as claimed in claim 7, wherein the means for determining the second parameter value is operable to associate the first parameter value with a nominal time position within the first time interval in response to the time association, and to determine the second parameter value in response to the first parameter value and the nominal time position.

9. The apparatus as claimed in claim 8, wherein the means for determining the second parameter value is operable to determine the second parameter value in response to an interpolation in response to the first parameter value and the nominal time position.

10. The apparatus as claimed in claim 1, wherein the input signal is a parametric encoded audio signal.

11. The apparatus as claimed in claim 1, wherein the means for generating the frequency sample blocks comprises complex-exponential modulated filter banks.

12. The apparatus as claimed in claim 1, wherein the extension data comprises parametric stereo data.

13. The apparatus as claimed in claim 12, wherein the first parameter value is a parameter value of a stereo image parameter selected from the group consisting of:

a. Inter-channel Intensity Differences parameters;

b. Inter-channel Time or Phase differences parameters; and c. Inter-Channel Coherence parameters.

14. The apparatus as claimed in claim 1, wherein the means for modifying is operable to modify the data of the second frequency sample block to generate at least a first stereo channel frequency sample block.

15. A method of time scaling a signal, the method comprising the steps of:

receiving an input signal comprising a first signal and extension data associated with the first signal;

generating a time scaled signal of the first signal;

means for generating a frequency sample blocks for the time scaled signal, each frequency sample block corresponding to a fixed time interval of the time scaled signal, the fixed time interval being independent of a time scaling factor;

determining a first time-association between a first parameter value of the extension data and a first frequency sample block having an associated first time interval of the time scaled signal;

determining a second parameter value associated with a second frequency sample block in response to the first time-association and the first parameter value;

modifying data of the second frequency sample block in response to the second parameter value; and generating time domain output sample blocks from the frequency sample blocks.

16. A computer-readable storage medium having stored thereon a computer program enabling a processor to carry out the method as claimed in claim 15.

* * * * *